US005988282A

United States Patent [19]

Jennings et al.

[11] Patent Number: 5,988,282

[45] Date of Patent: Nov. 23, 1999

[54] PRESSURE COMPENSATED ACTUATED CHECK VALVE

[75] Inventors: Charles Jennings; Glen H. Cuiper, both of Houston, Tex.

[73] Assignee: ABB Vetco Gray Inc., Houston, Tex.

[21] Appl. No.: 08/995,301

[22] Filed: Dec. 22, 1997

Related U.S. Application Data

[60] Provisional application No. 60/034,367, Dec. 26, 1996.

[51] Int. Cl.[6] ..... E21B 33/035

[52] U.S. Cl. ..... 166/348; 166/86.1; 166/88.1; 166/88.4; 166/95.1; 166/97.1; 166/368

[58] Field of Search ..... 166/348, 368, 166/86.1, 88.1, 89.1, 88.4, 95.1, 97.1, 78.14, 90.1

[56] References Cited

U.S. PATENT DOCUMENTS

| | | | |
|---|---|---|---|
| 2,830,666 | 4/1958 | Rhodes | 166/97.1 |
| 2,939,534 | 6/1960 | Allen | 166/97.1 |
| 5,372,199 | 12/1994 | Cegielski et al. | 166/368 |
| 5,544,707 | 8/1996 | Hopper et al. | 166/382 |
| 5,575,336 | 11/1996 | Morgan | 166/330 |
| 5,868,204 | 2/1999 | Pritchett | 166/368 |
| 5,884,706 | 3/1999 | Edwards | 166/335 |

*Primary Examiner*—Hoang C. Dang
*Attorney, Agent, or Firm*—James E. Bradley

[57] ABSTRACT

A horizontal tree having a vertical bore and a horizontal production passage is landed in a wellhead housing. A tubing hanger lands in the bore and has a vertical passage and a horizontal passage that aligns with that of the tree. A retrievable first plug seals the vertical passage. A tree cap seals in the tree bore above the tubing hanger and has an axial passage. A retrievable second plug having a valve seals the tree cap passage. A vent port extends laterally through the tree cap between its axial passage and outer surface. A pair of seals on the second plug seal above and below the vent port. A tubing annulus passage communicates with the vent port and an annulus passage. The second plug serves as a second pressure barrier to the first plug and blocks the vent port when the valve is closed. The annulus passage is sealed from communication with a void between the plugs. The valve may be opened to release pressure in the void by applying pressure to an upper end of the check valve.

12 Claims, 2 Drawing Sheets

PRESSURE COMPENSATED ACTUATED CHECK VALVE

This application claims benefit of provisional application Ser. No. 60/034,367 filed Dec. 26, 1996.

TECHNICAL FIELD

This invention relates in general to oil and gas well Christmas trees, and in particular to a tree cap for a horizontal tree.

BACKGROUND ART

One type of wellhead assembly, particularly used offshore, is known as a horizontal tree. The well has a wellhead housing which contains casing hangers, each secured to a string of production casing that extends into the well. The tree mounts on top of the wellhead housing. The tree has a vertical bore and a horizontal or lateral production flow outlet. A tubing hanger lands in the bore of the tree and is secured to a string of production tubing extending through the casing hangers and into the well. The tubing hanger has a lateral flow passage that registers with the lateral passage of the horizontal tree.

A plug, normally wireline retrievable, fits in the vertical passage of the tubing hanger above the lateral passage. A tree cap fits above the tubing hanger in the bore of the tree. The tree cap may have a vertical passage within which a retrievable crown plug fits. A corrosion cap fits over the upper end of the tree.

A tubing annulus between the tubing and the casing communicates to a lower annulus port formed in the tree. This port leads through an annulus passage to an upper annulus port which extends into the bore of the tree above the tubing hanger seals. One or more valves are used to open and close the tubing annulus. The upper tubing annulus port communicates with a void that is located between the tubing hanger wireline plug and the seal of the internal tree cap. In the prior art, removing the crown plug from the internal tree cap will provide a communication between the upper tubing annulus port and the vertical passage in the internal tree cap.

SUMMARY OF THE INVENTION

A horizontal tree having a vertical bore and a horizontal production passage is landed in a wellhead housing. A tubing hanger lands in the bore and has a vertical passage and a horizontal passage that aligns with that of the tree. A retrievable first plug seals the vertical passage. A tree cap seals in the tree bore above the tubing hanger and has an axial passage. A retrievable second plug having a valve seals the tree cap passage. A vent port extends laterally through the tree cap between its axial passage and outer surface. A pair of seals on the second plug seal above and below the vent port. A tubing annulus passage communicates with the vent port and an annulus passage. The second plug serves as a second pressure barrier to the first plug and blocks the vent port when the valve is closed. The annulus passage is sealed from communication with a void between the plugs. The valve may be opened to release pressure in the void by applying pressure to an upper end of the check valve.

BEST MODE FOR CARRYING OUT THE INVENTION

Figure 1:
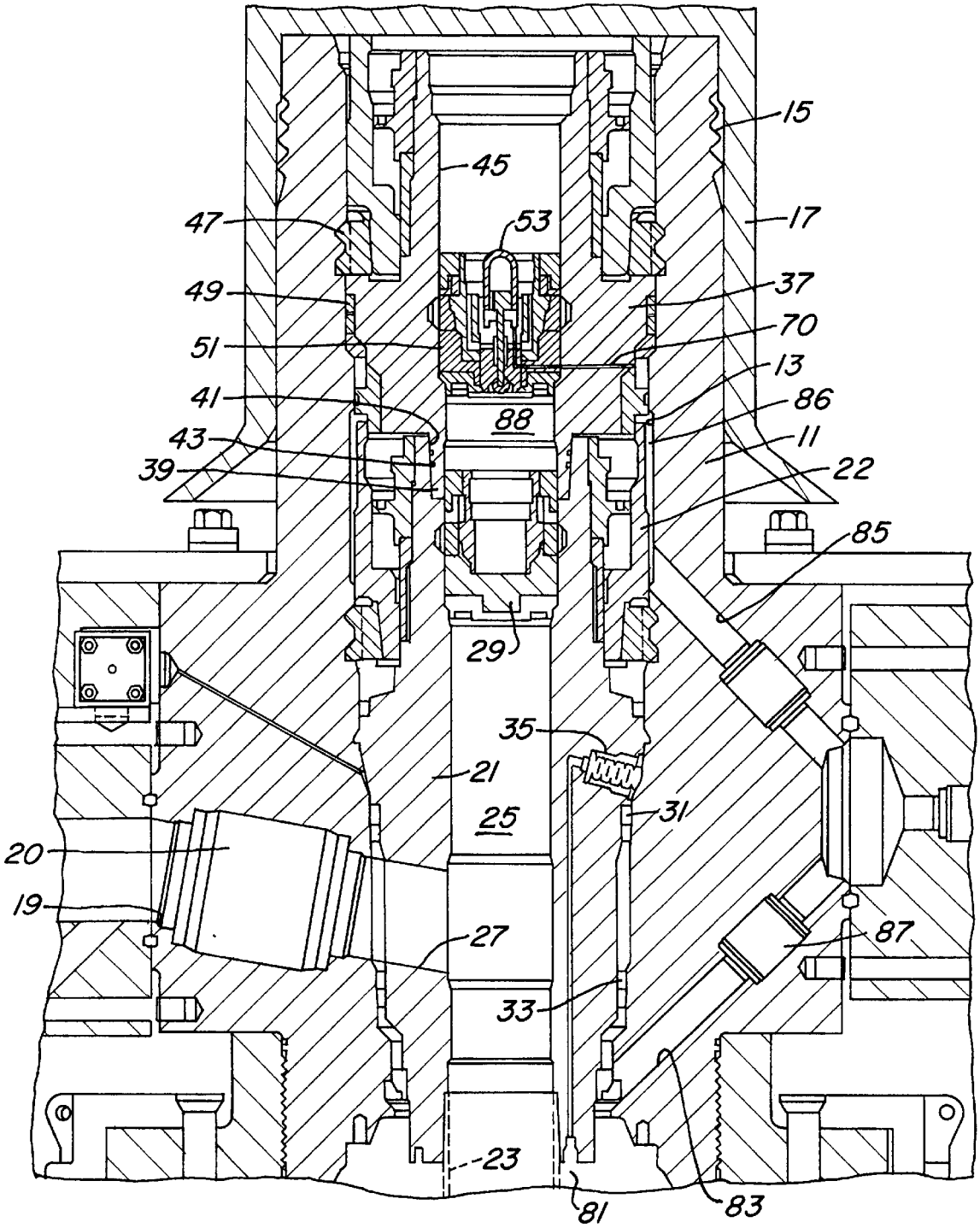
FIG. 1 is a vertical sectional view of a portion of a horizontal tree constructed in accordance with this invention.

Referring to FIG. 1, Christmas tree 11 is of a type known as a horizontal tree. It has a vertical or axial tree bore 13 extending completely through it. A set of grooves 15 is located on the exterior near the upper end for connection to a drilling riser (not shown). A removable corrosion cover 17 fits over the upper end of tree 11. Tree 11 has a lateral production passage 19 that extends generally horizontally from bore 13 and is controlled by a valve 20. Tree 11 will be landed on top of a wellhead housing (not shown) which has casing extending into a well.

A tubing hanger 21 lands sealingly in bore 13. Tubing hanger 21 is secured to tree 11 by a lock down mechanism 22. A string of production tubing 23 extends through the casing hangers (not shown) into the well for the flow of production fluid. Production tubing 23 communicates with a vertical passage 25 that extends through tubing hanger 21. A lateral passage 27 extends from vertical passage 25 and aligns with tree lateral passage 19.

A wireline retrievable plug 29 will lock in vertical passage 25, sealing the upper end of vertical passage 25. Tubing hanger 21 has an upper seal 31 located above lateral passage 27 and a lower seal 33 located below lateral passage 27. Seals 31 and 33 seal to bore 13 of tree 11. Radial ports 35 in tubing hanger 21 are used to communicate hydraulic fluid to a downhole safety valve. These ports register with passages formed in tree 11.

A tree cap 37 inserts sealingly into tree bore 13 above tubing hanger 21. Tree cap 37 has a downward depending isolation sleeve 39 that is coaxial. Sleeve 39 fits within a receptacle 41 formed on the upper end of tubing hanger 21. Seals 43 located on sleeve 39 seal to receptacle 41. The interior of sleeve 39 communicates with an axial passage 45 that extends through tree cap 37. Axial passage 45 has the same inner diameter as tubing hanger passage 25. A locking mechanism 47 similar to that of tubing hanger locking mechanism 22 is used to lock tree cap 37 to tree 11. A seal 49 seals tree cap 37 to tree bore 13.

Figure 2:
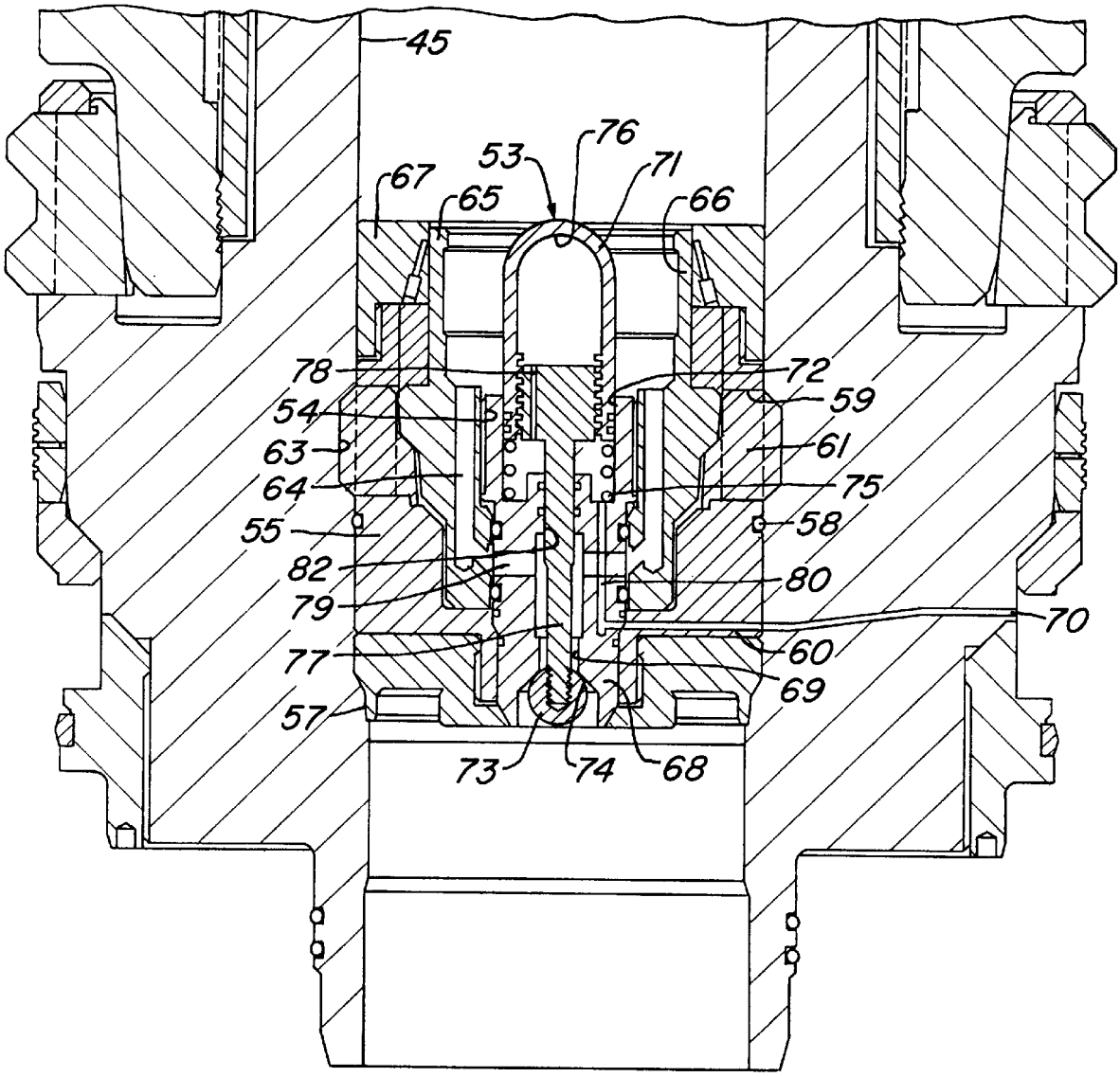
FIG. 2 is an enlarged view of the internal tree cap of the horizontal tree of FIG. 1 showing a crown plug assembly.

A wireline retrievable crown plug 51 inserts into tree cap passage 45. Crown plug 51 has a vent check valve 53 that, when opened, will allow pressure from below to vent upward above check valve 53. Referring to FIG. 2, check valve 53 has a body 55 which has a metal seal 57 secured to its lower end. Seal 57 is a depending lip that seals against a tapered surface formed in tree cap passage 45. A passage 70 extends through laterally through a sidewall in internal tree cap 37 and registers with a lateral passage 60 in check valve 53. Passage 70 stops at the outer surface of tree cap 37 and does not penetrate tree 11. Body 55 has a circumferential seal 58 at its midsection. Seals 58 and 57 are located above and below the junction of passage 70 and passage 60. Body 55 has a plurality of windows 59 which allows dogs 61 to protrude through. When in the outer locked position, dogs 61 will engage a groove 63 in tree cap passage 45. A cam member 65 is carried reciprocally within body 55. When in the lower position, cam member 65 keeps dogs 61 in the outer locked position. When cam member 65 is pulled upward, it will allow dogs 61 to retract from groove 63. Cam member 65 has a profile 66 on its upper end to allow engagement of a running and retrieval tool (not shown). A retainer 67 secures to the upper end of body 55 to retain cam member 65. A vent port 69 extends axially through body 55 to the lower end of cam member 65.

Check valve 53 has a check valve body 68 and is located within a cavity 54 in cam member 65. Check valve includes a piston head 71 which is secured to a piston shaft 77. Piston head 71 is sealed to and reciprocates within a bore 72 in check valve body 68. Piston shaft 77 is smaller in cross-sectional area than bore 72 and extends sealingly through a passage 82 in the body of valve 53. A ball 73 is threaded onto a lower end of piston shaft 77 and seals in a seat 74 which is located below vent port 69. A spring 75 urges piston shaft 77 upward. Cam member 65 contains passages 64 which communicate with bore 45 through profile 66 on an upper end, and which register with flow channels 79 in check valve body 68 on a lower end.

Pumping fluid down bore 45 will push piston head 71 and piston shaft 77 downward. Piston head 71 is hollow has a cavity 76 which is partially filled with a gas. Cavity 76 communicates with an equalizing passage 78 which extends through an upper portion of piston shaft 77 and communicates with bore 72. Bore 72 communicates with an equalizing passage 80 which extends through check valve body 68. Passage 80 communicates with equalizing passage 60 which extends through plug body 55 and registers with outer passage 70. Passage 80 does not intersect flow channel 79. During installation of internal tree cap 37, passages 80 and 60 equalize pressure on the lower side of piston shaft 77 due to hydrostatic pressure on the upper side of piston head 71, which keeps piston head 71 from moving downward. When bore 72 is pressurized, fluid in cavity 76 adds to the force exerted by spring 75 to urge piston shaft 77 and piston head 71 up.

Referring again to FIG. 1, a tubing annulus 81 surrounds tubing 23 between tubing 23 and the smallest diameter string of casing (not shown). Tubing annulus 81 communicates with a lower annulus passage 83 that extends from tree bore 13 through the wall of tree 11 below tubing hanger seal 33. Lower annulus passage 83 communicates with an upper annulus passage 85 that extends into tree bore 13 above tubing hanger seal 31 and below tree cap seal 49. An annular outer void 86 exists between tubing hanger seal 31 and tree cap seal 49, surrounding isolation sleeve 39. An inner void 88 between wireline plugs 29, 51 within isolation sleeve 39 is sealed from outer void 86 by seals 43 of sleeve 39. Passage 85 communicates with passage 70. Valves 87 are located in the tubing annulus passages 83 and 85.

In operation, after the well is drilled and cased, horizontal tree 11 will be landed and connected to the wellhead housing (not shown). Tubing 23 will be lowered into the well on tubing hanger 21. Horizontal passage 27 will orient with passage 19 when tubing hanger 21 lands in tree 11. Wireline plug 29 will be installed in tubing hanger vertical passage 25.

Preferably, plug 51 will be installed in tree cap 37 and pressure tested while tree cap 37 is at the drilling rig. Tree cap 37 will be lowered on a running tool on drill pipe. Both sides of plug 51 will be subjected to hydrostatic pressure while it is being lowered. Check valve 53 in a closed position. Once isolation sleeve 39 begins to stab into receptacle 41, check valve 53 will be forced into an open position. As isolation sleeve 39 stabs into receptacle 41, check valve 53 is opened by increasing the pressure of the fluid in bore 45. The increased fluid pressure applies a greater force on piston head 71 than is being applied to ball 73. The open position of check valve 53 allows displacement of trapped fluid between plugs 29, 51. The fluid flows up vent port 69 and through passages 79 and 64 into tree cap passage 45 above plug 51. After installation, the pressure on piston head 71 is relieved, causing check valve 53 to close due to the force of spring 75. Check valve 53 serves as a second pressure barrier to wireline plug 29 and blocks port 70.

For a workover operation requiring the pulling of tubing 23, the operator may use a drilling riser and blowout preventer stack (not shown). After removal of corrosion cover 17, the drilling riser will connect to profile 15. Normally, a kill fluid will be circulated into the well which is heavier than the well fluid to prevent a blowout. The operator will pressurize passage 45, which at the same time depresses plunger 77 to vent any pressure buildup in inner void 88 between the two plugs 29, 51. This will inform the operator whether or not tubing hanger wireline plug 29 had been leaking.

The operator then pulls internal tree cap 37 and runs back in with an inner riser string (not shown) which stabs into receptacle 41 of tubing hanger 21. Pipe rams (not shown) in the drilling riser are closed around the inner riser string. Upper tubing annulus passage 85 now communicates with an annulus surrounding the inner riser, which in turn communicates with choke and kill lines leading alongside the riser back to the drilling rig. The operator will pull plug 29 with a wireline tool. A port (not shown) at the lower end of tubing 23 will be opened to communicate the interior of tubing 23 with tubing annulus 81. This may be done with a wireline tool in a conventional manner. With production valve 20 closed and tubing annulus valve 87 open, the operator can pump down the inner riser, down tubing 23 and back up tubing annulus 81. The annulus fluid circulates through annulus passages 83, 85 up tree bore 13 and through the choke and kill lines to the surface. After the kill fluid has been placed in the well, the operator may pull production tubing 23.

Under some circumstances, an operator may wish to achieve wireline intervention into tubing 23 without killing the well and without using the drilling riser. Wireline access is achievable with the well under flowing conditions. A wireline riser (not shown) will be installed in the upper portion of passage 45 of tree cap 37. The operator can use a wireline tool to engage crown plug 51. Check valve 53 will be opened to vent off any pressure buildup that might exist in inner void 88 between tubing hanger wireline plug 29 and crown plug 51. The operator will retrieve plugs 29 and 51 in a conventional manner to perform the wireline intervention. When reinstalling crown plug 51, check valve 53 will be opened to allow displacement of trapped fluid in inner void 88. The invention has several advantages. The check valve releasably seals the axial passage of the tree cap or tubing hanger while having the capacity to relieve pressure in the void between the two plugs. The check valve will remain open until the pressure above and below it equalizes. The check valve may be opened by exerting pressure in the bore above the check valve.

While the invention has been shown in only one of its forms, it should be apparent to those skilled in the art that it is not so limited, but is susceptible to various changes without departing from the scope of the invention.

I claim:

1. A wellhead assembly, comprising in combination:

a christmas tree having an axial bore and a lateral production passage;

a tubing hanger landed in the bore of the tree and having an axial bore and a lateral opening that aligns with the lateral production passage in the tree;

a retrievable first plug landed in the bore of the tubing hanger above the lateral opening;

an internal tree cap landed in the bore of the tree above the tubing hanger, the internal tree cap having an axial passage;

a retrievable second plug landed in the axial passage of the internal tree cap;

a vent passage in the second plug which extends from below the second plug to the axial passage of the internal tree cap above the second plug; and a valve located within the second plug which selectively opens and closes the vent passage in response to hydraulic pressure being applied to the axial passage of the internal tree cap above the second plug.

2. The wellhead assembly of claim 1 further comprising an isolation sleeve on the internal tree cap which sealingly engages the axial bore of the tubing hanger, thereby creating a sealed inner void; and wherein the valve opens the vent port to relieve pressure in the inner void.

3. The wellhead assembly of claim 1 wherein the valve has a piston which moves up and down to close and open the valve when an upper side of the piston is exposed to pressure in the axial passage of the internal tree cap; and wherein the wellhead assembly further comprises:

a spring in the second plug which urges the piston upward to the closed position.

4. The wellhead assembly of claim 1 wherein the valve has a piston which moves up and down to close and open the valve when an upper side of the piston is exposed to pressure in the axial passage of the internal tree cap; and wherein the wellhead assembly further comprises:

an equalizing passage extending through the second plug from a lower side of the piston to expose the lower side of the piston to the same pressure in the axial passage of the internal tree cap.

5. The wellhead assembly of claim 1 wherein the valve has a piston which moves up and down to close and open the valve when an upper side of the piston is exposed to pressure in the axial passage of the internal tree cap; and wherein the wellhead assembly further comprises:

an equalizing passage extending through the second plug from a lower side of the piston to expose the lower side of the piston to the same pressure in the axial passage of the internal tree cap; and a seal between the internal tree cap and the tree;

an equalizing passage in the internal tree cap which extends to an exterior side of the internal tree cap below the seal, so that once the internal tree cap lands in the bore, the equalizing passage of the internal tree cap is blocked and increased pressure applied to the upper side of the piston is not applied to the lower side of the piston.

6. A wellhead assembly, comprising in combination:

a Christmas tree having an axial bore and a lateral production passage;

a tubing hanger landed in the bore of the tree and having an axial bore and a lateral opening that aligns with the lateral production passage in the tree;

a retrievable first plug landed in the bore of the tubing hanger above the lateral opening;

an internal tree cap landed in the bore of the tree above the tubing hanger, the internal tree cap having an axial passage;

a retrievable second plug landed in the axial passage of the internal tree cap and having a valve seat on a lower end;

a vent passage in the second plug which extends from below the second plug to the axial passage of the internal tree cap above the second plug;

a valve located within the second plug which selectively opens and closes the vent passage in response to hydraulic pressure being applied to the axial passage of the internal tree cap above the second plug;

an isolation sleeve on the internal tree cap which sealingly engages the axial bore of the tubing hanger, thereby creating a sealed inner void;

a piston having a piston shaft and a valve member on a lower end which releasably engages the valve seat on the second plug, the piston being movable up and down to close and open the valve when an upper side of the piston is exposed to pressure in the axial passage of the internal tree cap; and wherein the piston opens the vent port to relieve pressure in the inner void.

7. The wellhead assembly of claim 6, further comprising:

an equalizing passage extending through the second plug from a lower side of the piston to expose the lower side of the piston to the same pressure in the axial passage of the internal tree cap;

a seal between the internal tree cap and the tree; and an equalizing passage in the internal tree cap which extends to an exterior side of the internal tree cap below the seal, so that once the internal tree cap lands in the bore, the equalizing passage of the internal tree cap is blocked and increased pressure applied to the upper side of the piston is not applied to the lower side of the piston.

8. The wellhead assembly of claim 7, further comprising:

a compressible gas contained within the piston; and a spring in the second plug which urges the piston upward to the closed position.

9. The wellhead assembly of claim 7, further comprising a tubing annulus port in the tree; and wherein the equalizing passage of the internal tree cap aligns with the tubing annulus port.

10. A method for install an internal tree cap in a wellhead assembly having a tree with a tree bore, a tubing hanger with an axial bore and a retrievable first plug in the axial bore, comprising:

(a) providing an internal tree cap with an axial passage;

(b) providing a retrievable second plug with a vent passage which extends from below the second plug to the axial passage of the internal tree cap above the second plug;

(c) providing a valve in the vent passage which selectively opens and closes the vent passage in response to hydraulic pressure being applied to the axial passage of the internal tree cap above the second plug;

(d) installing the second plug in the axial passage of the internal tree cap;

(e) landing the internal tree cap in the tree bore; and then (f) applying pressure to the valve through the axial passage to open the valve to allow pressure in a void between the plugs to equalize with pressure in the axial passage above the second plug.

11. The method of claim 10 wherein step (d) occurs before step (e).

12. The method of claim 10 wherein step (d) occurs after step (e).

* * * * *